United States Patent [19]

Eiloart et al.

[11] 4,246,737

[45] Jan. 27, 1981

[54] METAL STRUCTURAL MEMBERS

[75] Inventors: Nigel C. Eiloart, Caledon; Gordon A. Webster, Dundas, both of Canada

[73] Assignee: Brockhouse Canada Limited, Bramalea, Canada

[21] Appl. No.: 951,990

[22] Filed: Oct. 16, 1978

Related U.S. Application Data

[63] Continuation-in-part of Ser. No. 832,212, Sep. 12, 1977, abandoned.

[51] Int. Cl.[3] ..... E04C 3/32; E04C 17/00

[52] U.S. Cl. ..... 52/729; 29/155 R

[58] Field of Search ..... 52/921, 729, 84; 244/123, 124; 29/155 R

[56] References Cited

U.S. PATENT DOCUMENTS

| | | | |
|---|---|---|---|
| 2,233,969 | 3/1941 | Woods | 244/123 |
| 2,390,761 | 12/1945 | Watter | 52/84 |
| 2,567,124 | 9/1951 | Roberts | 244/124 |
| 3,204,382 | 9/1965 | McGurn | 52/349 |
| 3,831,333 | 8/1974 | Nelsson et al. | 52/721 |

FOREIGN PATENT DOCUMENTS

| | | | |
|---|---|---|---|
| 131947 | 6/1929 | Switzerland | 29/155 R |

*Primary Examiner*—James L. Ridgill, Jr.

*Attorney, Agent, or Firm*—Hirons, Rogers & Scott

[57] ABSTRACT

The invention is concerned with metal structural members of the type having spaced parallel flanges and an intervening connecting web perpendicular to the flanges. One or both ends of the member is offset to permit it to be inserted between non-offset flanges of another member and thereby obtain a flush surface at their junction. Such a member comprises, for example, a joist for the floor structure of a mobile home. The offset end is formed simultaneously to have part of the web at the offset displaced transversely so that the surplus metal, which might otherwise wrinkle and weaken the web, forms instead stiffening ribs therein. The member may be rolled from a continuous strip of metal with the steps of offsetting the flange, displacing the web transversely, and severing the strip into separate structural members all carried out on a continuously operating production line.

4 Claims, 2 Drawing Figures

METAL STRUCTURAL MEMBERS

CROSS-REFERENCE TO RELATED APPLICATION

Figure 1:
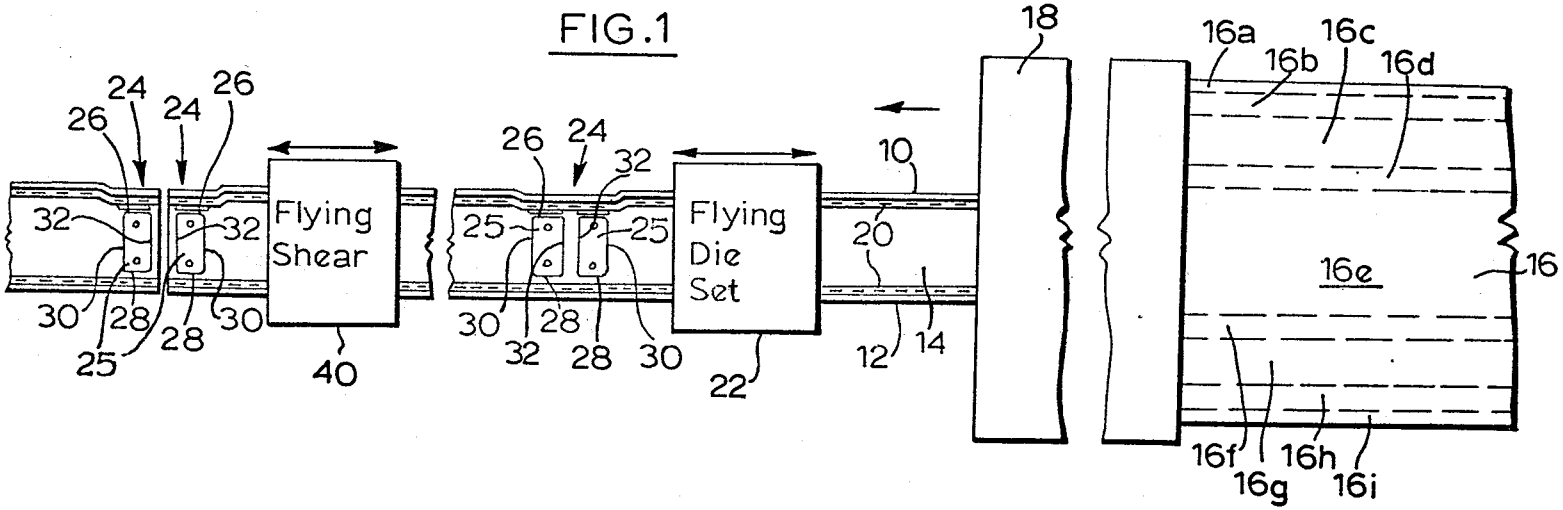

This application is a continuation-in-part of an Application Ser. No. 832,212 filed Sept. 12th, 1977 abandoned.

This invention is concerned with improvements in or relating to metal structural members, such as beams, joists, posts or rafters formed from sheet metal, and to methods of making such members by continuous rolling.

In fabricating structures from structural members, whatever the material used, it is frequently necessary to ensure that a resultant surface is flat, for example for convenient laying of flooring thereon, and to this end a flange or flanges at the end of one member abutting or inserted into another member must be removed (referred to in steel construction as flange coping), or offset the flange thickness, so that the adjoining flanges are coplanar. This removal or offset usually necessitates an additional operation and frequently results in a weakening of the members at the ends, where additional strength is usually of great importance.

There has been disclosed in U.S. Pat. No. 3,831,333 issued Aug. 27th, 1974, a crimped end load bearing member and assemblies thereof in which the ends are tapered and stiffened by means of a rib in the central web of the member. In one embodiment in which the load bearing member is a joist this rib is formed extending generally perpendicular to the long axis of the member, the rib by its depth causing the side flange to taper inwardly.

It is therefore an object of the invention to provide a new metal structural member having a flange offset at its ends, and a new method of making such a member.

In accordance with the present invention there is provided a metal structural member comprising two spaced flanges and an intervening connecting web, wherein at least one end part of one of the flanges is offset toward the other flange to permit the insertion of the respective member end between the flanges of another similar member, the intervening portion of the web between the said offset flange part and the corresponding part of the other flange having an area thereof displaced out of its plane transverse thereto, whereby the boundary of the displaced area provides at least first and second transverse stiffening ribs in the web spaced from the respective adjacent web end and spaced from one another, the first endmost transverse stiffening rib being nearer to the adjacent web end, and the second transverse stiffining rib being disposed at least approximately at the junction of said offset flange part and the remainder of the flange.

Also in accordance with the invention there is provided a method of forming a metal structural member including the steps of:

(a) rolling a strip of metal to a cross-section comprising two spaced flanges and an intervening connecting web, and (b) forming at least one end part of the member by engagement of a die therewith to have the respective part of one of the flanges offset toward the corresponding part of the other flange to permit the insertion of the respective member end between the flanges of another similar member, and to have an area of the intervening portion of the web between the said offset flange and the corresponding part of the other flange displaced out of its plane transverse thereto, whereby the boundary of the displaced area provides at least first and second transverse stiffening ribs in the web spaced from the respective adjacent web end, and spaced from one another, the first endmost transverse stiffening rib being nearer to the adjacent web end, and the second transverse stiffening rib being disposed at least approximately at the junction of said offset flange part and the remainder of the flange.

Figure 2:
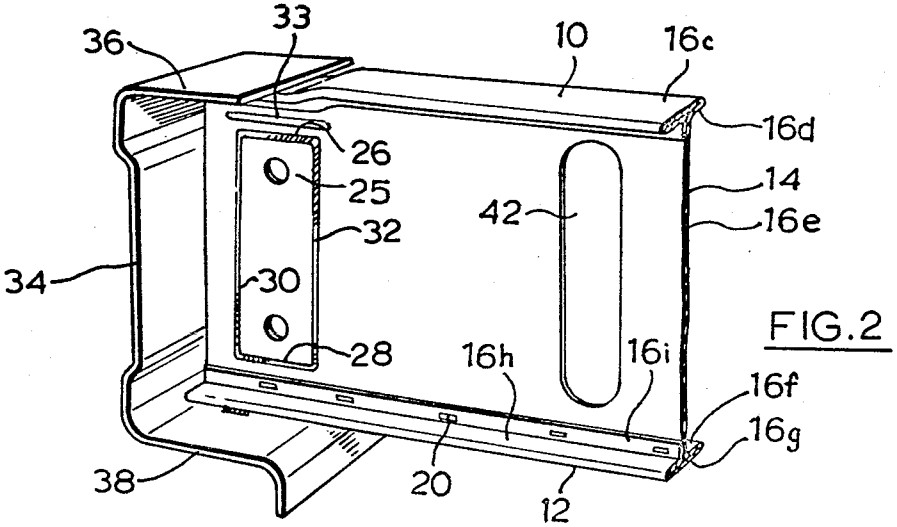

Processes and products which are particular preferred embodiments of the invention will now be described, by way of example, with reference to the accompanying diagrammatic drawings, wherein:

FIG. 1 is a schematic of a rolling process of the invention by which structural members of the invention may be manufactured on a continuous basis, and FIG. 2 is a perspective view of one end of a structural member constituting an embodiment of the invention to show the flange offset and web displacement.

The invention is described as applied to the production of a metal structural member consisting of a floor joist intended for forming the floor framework of a mobile home, but is also applicable to other structural members of the same general type having two spaced flanges and an intervening connecting web, such as beams, rafters, purlins, etc., as will be apparent to those skilled in the art. The joist consists of two spaced parallel flanges 10 and 12 connected together by an intervening web 14 that is perpendicular to both flanges, the lines of connection of the web to the flanges being along the respective longitudinal centre lines of the flanges. The member is formed by rolling from a strip of metal and, as illustrated by FIG. 1, the metal strip 16 from a supply roll thereof (not shown) enters a rolling station 18 in which it is folded to a continuous strip of uniform cross-section along its length. The flange 10 is formed from strip bands **16*b* through 16*d*, the web 14 is formed from band 16*e*, while the flange 12 is formed from bands 16*f* through 16*i*. The narrow strip edge bands 16*a* and 16*i* are folded alongside the adjacent part of the web band 16*e* and are tacked, welded or otherwise fastened thereto by connections 20**. The structure and operation of such a roll station will be apparent to those skilled in that particular art, and is not believed to require any more detailed explanation for a full description and understanding of the present invention.

The continuously-moving uniform cross-section strip exiting from the station 18 is subjected to the action of a flying die set 22, which is arranged in known manner to accelerate along the strip in its direction of travel and, at a predetermined location along its length, and while travelling at the same speed as the strip, to perform a metal-working operation thereon. As soon as the operation is completed the die set is returned along the length of the strip against its direction of travel and the step repeated.

The metal-working step that is performed in accordance with this invention consists of offsetting a part 24 of the flange 10 toward the flange 12 to provide an offset that usually will be equal to the thickness of the flange 10, although the precise amount of offset may of course vary with the application. Simultaneously an area 25 of the intervening portion of the web 14 between the offset flange part and the corresponding opposite part of the flange 12 is displaced out of the plane of the web transverse thereto, so that its boundary forms spaced parallel longitudinal stiffening ribs 26 and 28 and spaced parallel transverse stiffening ribs 30 and 32 extending between the two ribs 26 and 28, so that together a parallelopiped-shaped, specifically a rectangular-shaped, displaced area is formed. Thus, the part of the web 14 that otherwise would be wrinkled and distorted, and thereby weakened, by the inward movement of the intervening portion of flange 10, is formed to a highly useful configuration, providing stiffening ribs that rigidify the member ends in a manner and precisely at the locations in the length thereof at which such rigidification is most desirable.

The provision of the transversely displaced area is also extremely advantageous in the process of forming the member, in that it provides means for positively holding the end in the die set while the portion of flange 10 is offset accurately by the necessary severe blow from the side; in the absence of this offset area this sideways blow could cause slipping of the metal sheet sideways in the die reducing the accuracy of formation.

The flange 14 is additionally provided with a longitudinal stiffening rib 33 interposed between the displaced area 25 and the offset portion of the flange 10, the rib 33 therefore paralleling the rib 26. This rib 33 absorbs any additional buckling or wrinkling that may be produced by the flange offsetting.

The spacing of the transverse rib 30 from the adjacent free edge of the web 10 preferably is between 20 and 30 times the thickness of the metal of the web. If this spacing is more than 30 times such thickness then some wrinkling may still be obtained, while a spacing smaller than 20 times is unnecessary for the advantageous effect of the rib to be obtained, and may adversely effect the location of the other rib 32, in view of the need of the displaced part to be of a size to accommodate the amount of metal displaced by the flange offsetting. The stiffening effect of the reinforcing rib 32 usually is much more important than that of the rib 30, and it is located so that a major portion of the reaction load force on the joist from the joist support passes through it. In this embodiment this joist support is shown as comprising a channel member 34, into which the offset end of the joist is inserted, with the upper surface of the upper flange 10 flush with the corresponding surface of the channel side wall 36, the joist resting on the other side wall 38.

The strip with its displaced areas 25 and its offset portions 24 is, for clarity of illustration only, shown in FIG. 1 as subsequently being subjected to the action of a flying shear 40, which cuts the strip equidistantly between the two areas 25, thereby forming simultaneously the offset trailing end of the preceding joist and the offset leading end of a succeeding joist. In practice it is much more likely that the die set will include its own cutting structure, so that both metal-working operations are performed simultaneously. The web of the joist may also be provided with various cut-outs, such as that indicated at 42, for the passage of pipes, wires, etc., through the structure into which it is incorporated.

We claim:

1. A metal structural member comprising two spaced flanges and an intervening connecting web, wherein at least at one end thereof part of one of the flanges is offset toward the other flange to permit the insertion of the respective member end between the flanges of another similar member, the intervening portion of the web between the said offset flange part and the corresponding part of the other flange having an area thereof displaced out of its plane transverse thereto, whereby the boundary of the displaced area is of parallelopiped shape to provide first and second transverse stiffening ribs in the web extending substantially from flange to flange spaced from the respective adjacent web end and spaced from one another, the first endmost transverse stiffening rib being spaced from the adjacent web end a distance between 20 and 30 times the thickness of the web metal, and the second transverse stiffening rib being disposed at least approximately at the junction of said offset flange part and the remainder of the flange, the displaced area also providing first and second spaced longitudinal ribs extending parallel to one another closely adjacent to their respective flanges and conecting the two transverse ribs.

2. A member as claimed in claim 1, wherein both ends of the member have the respective flange parts offset and the intervening web parts have respective areas displaced out of its plane to provide respective first and second transverse stiffening ribs and first and second spaced longitudinal ribs.

3. A member as claimed in claim 1, wherein a separate longitudinal rib of approximately the length of the first and second longitudinal ribs is provided in the said intervening web portion between the said displaced area and the offset flange part parallel to and coextensive with the said first and second longitudinal ribs to absorb wrinkling produced by the formation of the offset flange end part.

4. A method of forming a metal structural member including the steps of:

(a) rolling a strip of metal to a cross-section comprising two spaced flanges and an intervening connecting web; and (b) forming at least one end part of the member by engagement of a die therewith to have the respective part of one of the flanges offset toward the corresponding part of the other flange to permit the insertion of the respective member end between the flanges of another similar member, and to have an area of the intervening portion of the web between the said offset flange and the corresponding part of the other flange displaced out of its plane transverse thereto, whereby the boundary of the displaced area is of parallelopiped shape to provide first and second transverse stiffening ribs in the web extending substantially from flange to flange, spaced from the respective adjacent web end, and spaced from one another, the first endmost transverse stiffening rib being spaced from the adjacent web end a distance between 20 and 30 times the thickness of the web metal, and the second transverse stiffening rib being disposed at least approximately at the junction of said offset flange part and the remainder of the flange, the displaced area also providing first and second spaced longitudinal ribs extending parallel to one another closely adjacent to their respective flanges and connecting the two transverse ribs.

* * * * *